United States Patent [19]

Uchida

[11] Patent Number: 4,977,309

[45] Date of Patent: Dec. 11, 1990

[54] ORGANIC PTC THERMISTOR

[75] Inventor: Katsuyuki Uchida, Nagaokakyo, Japan

[73] Assignee: Murata Manufacturing Co., Ltd., Japan

[21] Appl. No.: 334,079

[22] Filed: Apr. 6, 1989

[51] Int. Cl.[5] ..... H05B 3/02

[52] U.S. Cl. ..... 219/541; 219/543

[58] Field of Search ..... 219/538, 541, 542, 543, 219/544, 548

[56] References Cited

U.S. PATENT DOCUMENTS 4,652,727 3/1987 Hoshizaki ..... 219/541

*Primary Examiner*—Roy N. Envall, Jr.

*Attorney, Agent, or Firm*—Ostrolenk, Faber, Gerb & Soffen

[57] ABSTRACT

An organic positive temperature coefficient (PTC) thermistor includes an organic PTC thermistor sheet on one main surface of which a pair of electrodes are formed. A conductive sheet is adhered on each of the electrodes at terminal fixing portion by, for example, conductive adhesives. Both main surfaces of the organic PTC thermistor sheet together with the conductive sheets and the electrodes are covered by insulation film. A terminal is inserted so as to penetrate the insulation film, each of the conductive sheets, each of the electrodes, the organic PTC thermistor sheet and the insulation film, and then crimped.

9 Claims, 2 Drawing Sheets

ORGANIC PTC THERMISTOR

BACKGROUND OF THE INVENTION

1. Field of the Invention

The present invention relates to an organic positive temperature coefficient (PTC) thermistor. More specifically, the present invention relates to an organic PTC thermistor in which a pair of electrodes are formed on one main surface of an organic PTC thermistor sheet which is covered by insulation film, each electrode has a conductive sheet laminated thereon, and a terminal is inserted so that it penetrates the insulation film, respective conductive film, the corresponding electrode, and the organic PTC thermistor sheet.

2. Description of the Prior Art

If conductive particles such as carbon black, graphite, metallic powder or the like are mixed and distributed in a polyolefin family resin such as polyethylene, the resin takes on the characteristics of a PTC thermistor. It has been known that it is possible to construct a heating plate by forming such a resin having the characteristics of a PTC thermistor into an organic PTC thermistor sheet and by forming a pair of electrodes on one main surface of the organic PTC thermistor sheet.

A configuration of one example of a conventional PTC thermistor which utilizes such an organic PTC thermistor sheet is shown in FIG. 1. More specifically, an electrode 2 is formed on an organic PTC thermistor sheet 1 and the electrode 2 and the organic PTC thermistor sheet 1 are covered by insulation film 3 and 4. Then, a terminal 5 is inserted so as to penetrate the insulation film 3, electrode 2, organic PTC thermistor sheet 1 and the insulation film 4, and crimped.

In the conventional PTC thermistor as shown in FIG. 1, when the terminal 5, is crimped the organic PTC thermistor 1 is deformed. At this time, since the electrode 2 has been formed by printing conductive paste and lacks elasticity, the electrode in the vicinity of a portion where the terminal is crimped is destroyed. Therefore, contact between the terminal 5 and the electrode 2 becomes unstable, and therefore, contact resistance becomes large. If the organic PTC thermistor is used in such a state, abnormal heat generation due to large contact resistance takes place, and therefore, the PTC thermistor is thermally destroyed.

SUMMARY OF THE INVENTION

Therefore, a principal object of the present invention is to provide a novel organic PTC thermistor.

The other object of the present invention is to provide an organic PTC thermistor in which no abnormal heat generation takes place at a contact region between a terminal and an electrode.

An organic PTC thermistor in accordance with the present invention comprises an organic PTC thermistor sheet; a pair of electrodes formed on one main surface of the organic PTC thermistor sheet; conductive sheets each of which is laid on a portion of each of the pair of electrodes; insulation film covering at least the conductive sheets and the electrodes; and terminals each of which is inserted so as to penetrate the insulation film, each of the conductive sheets, each of the electrodes and the organic PTC thermistor sheet, and then crimped.

In the organic PTC thermistor in accordance with the present invention, since the conductive sheet is inserted between the electrode and the insulation film at a terminal fixing portion, even if crimping pressure is applied to the terminal fixing portion of the electrode in crimping the terminal, no destruction of the electrode takes place. Even if a very small crack is formed in the terminal fixing portion of the electrode in crimping the terminal, the electrical contact state between the terminal and the electrode does not become unstable because the conductive sheet and the electrode remain in contact over each other with an area larger than that of the crack. Therefore, abnormal heat generation due to increase of the contact resistance and thus thermal destruction of the organic PTC thermistor does not take place.

These objects and other objects, features, aspects and advantages of the present invention will become more apparent from the following detailed description of the embodiments of the present invention when taken in conjunction with accompanying drawings.

DETAILED DESCRIPTION OF THE PREFERRED EMBODIMENT

Figure 1:
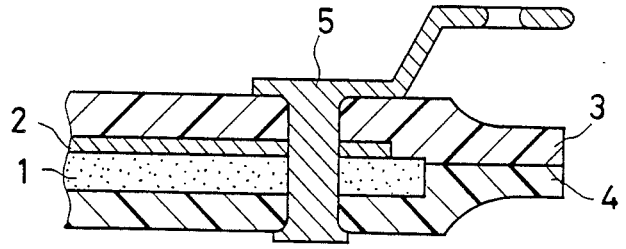
FIG. 1 PRIOR ART
FIG. 1 is an illustrative cross sectional view showing one example of a configuration of a conventional organic PTC thermistor.
Figure 4:
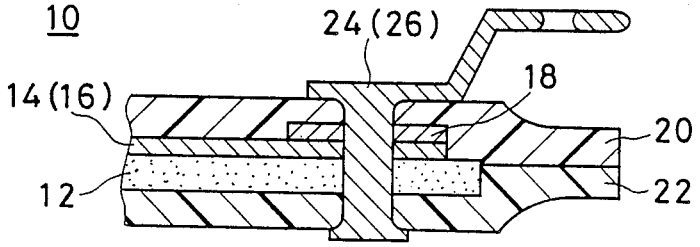
FIG. 4 is an illustrative sectional view showing an enlarged major portion of FIG. 2.
Figure 2:
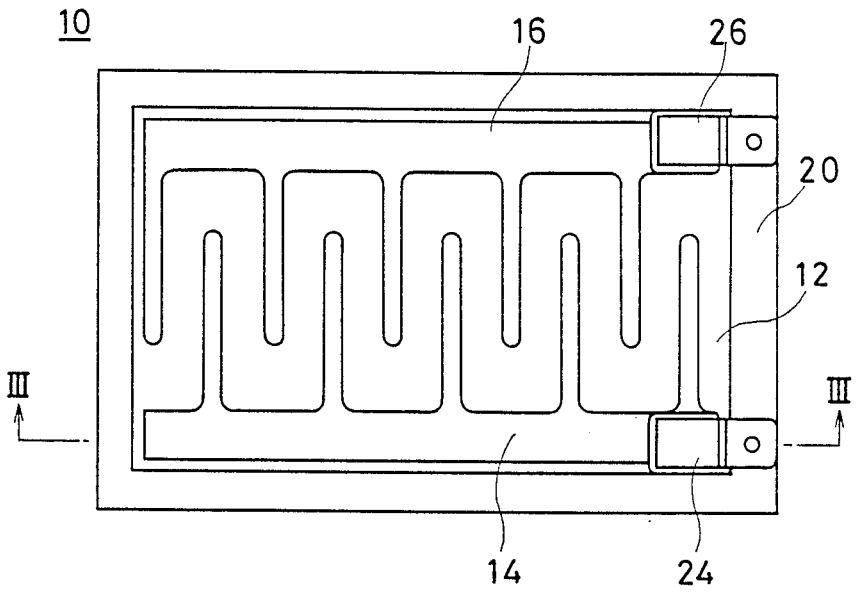
FIG. 2 is a top plan view showing one embodiment in accordance with the present invention.
Figure 3:
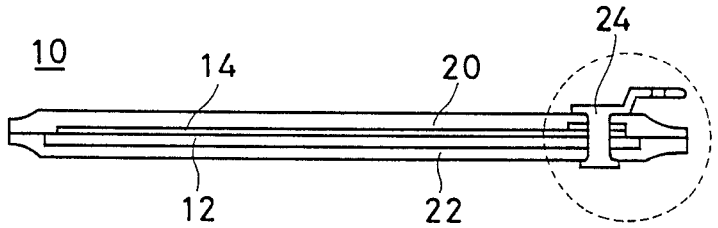
FIG. 3 is a cross-sectional view along a line III—III of FIG. 2.

With reference to FIG. 2 - FIG. 4, an organic PTC thermistor 10 in accordance with the present invention includes an organic PTC thermistor sheet 12 made of material which is obtained by mixing and distributing conductive particles such as carbon black, graphite, metallic powder or the like in a polyolefin family resin such as polyethylene. On one main surface of the organic PTC thermistor sheet 12, a pair of electrodes 14 and 16 each having a comb-shape are formed. The electrodes 14 and 16 are formed by, for example, printing conductive paste such as silver paste. The shape of each of the electrodes 14 and 16 can be changed arbitrarily.

As seen from especially FIG. 4, on the electrode 14 (16), conductive sheet 18 such as copper foil is adhered by conductive adhesives at a terminal fixing location and laminated on the electrode. As the conductive sheet 18, foil made of good conductive metal such as nickel, alminium or the like can be utilized.

The conductive sheet 18, electrode 14 (16) and the organic PTC thermistor sheet 12 thus formed are covered by insulation films 20 and 22 such as polyester film. The insulation film 20 and 22 are adhered to surfaces of the organic PTC thermistor sheet 12 by thermal fusion. However, instead of providing the covering by thermal fusion of such an insulation film, a cover can alternatively be provided by adhesion of insulation adhesive tape.

Then, terminals 24 and 26 are attached at the terminal fixing locations. More specifically, the terminal 24 (26) is inserted so as to penetrate the insulation film 20, the conductive sheet 18, the electrode 14 (16), the organic PTC thermistor sheet 12 and the insulation film 22, and crimped. The shapes of the crimped terminals 24 and 26 may be arbitrarily changed.

An experiment, first, a PTC thermistor resin is press-molded at 190° C. and 120 kg/cm$^2$ for 10 minutes to form an organic PTC thermistor sheet having thickness of 0.5 mm. The sheet is cut-out to obtain an organic PTC thermistor sheet of 50×100 mm and a pair of electrodes each having a predetermined pattern as shown in FIG. 2 are formed on the organic PTC thermistor sheet by screen printing of silver paste. Furthermore, copper foil of 5×5 mm and thickness of 35 μm is adhered to each of the electrodes at each of the terminal fixing locations. Then, both surfaces of the organic PTC thermistor sheet are covered by polyester film. Thereafter, the terminals are crimped at the terminal fixing locations.

Thus, 10 samples whose characteristics are to be measured or evaluated are manufactured. By contrast, 10 comparative samples, in each of which no conductive sheet 18, that is, copper foil is laminated, are manufactured. A resistance value between the terminals 24 and 26 (FIG. 2) of each of samples is measured. In the comparative samples, there was a very large dispersion of 8.3–150 ohms; however, in resistance values over the range of the samples embodying the invention, the resistance values between the terminals 24 and 26 were 5.3–7.6 ohms. Therefore, in accordance with this embodiment, the resistance value between the terminals becomes small and the dispersion thereof is also suppressed. Furthermore, when a voltage of DC 16V is applied between the terminals 24 and 26 of each of the samples, in the comparative samples, abnormal heat generation or sparking takes place at the terminal fixing location, but no such phenomenon takes place in the samples embodying the invention.

Thus, in accordance with the present invention, the contact resistance at a contact portion between the terminal and the electrode can be made small and dispersion thereof can be suppressed, and therefore, in the case where such an organic PTC thermistor sheet is used as a heating plate, abnormal heat generation or generation of sparks at the terminal fixing portion can be prevented, and therefore, it is possible to uniformly heat the whole surface of the organic PTC thermistor sheet. In addition, in the case where the organic PTC thermistor is used as a temperature sensor, since the dispersion of the contact resistance at the terminal fixing portion is small, it is possible to detect a temperature stably and precisely.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An organic PTC thermistor:

an organic PTC thermistor sheet;

a pair of electrodes formed on one main surface of said organic PTC thermistor sheet;

a pair of conductive sheets respectively formed on said pair of electrodes at respective terminal fixing locations;

an insulation cover covering at least said conductive sheets and said electrodes; and a pair of crimped terminals each penetrating said insulation cover, one of said conductive sheets, the corresponding one of said electrodes, and said organic PTC thermistor sheet.

2. An organic PTC thermistor in accordance with claim 1, wherein said conductive sheets are made of metal foil having good conductivity.

3. An organic PTC thermistor in accordance with claim 1, wherein said electrodes are made of an inelastic conductive material applied to said organic PTC thermistor sheet.

4. An organic PTC thermistor in accordance with claim 3, wherein said electrodes are formed of silver paste printed on said organic PTC thermistor sheet.

5. An organic PTC thermistor in accordance with claim 2, wherein said conductive sheets are adhered to said electrodes by a conductive adhesive.

6. An organic PTC thermistor in accordance with claim 1, wherein said conductive sheets are adhered to said electrodes by a conductive adhesive.

7. An organic PTC thermistor in accordance with claim 2, wherein said conductive sheets are made of copper foil.

8. An organic PTC thermistor in accordance with claim 7, wherein said electrodes are formed of silver paste printed on said organic PTC thermistor sheet.

9. An organic PTC thermistor in accordance with claim 8, wherein said conductive sheets are adhered to said electrodes by a conductive adhesive.

* * * * *

UNITED STATES PATENT AND TRADEMARK OFFICE

CERTIFICATE OF CORRECTION

PATENT NO. : 4,977,309

DATED : December 11, 1990

INVENTOR(S) : Katsuyuki UCHIDA

It is certified that error appears in the above-identified patent and that said Letters Patent is hereby corrected as shown below:

On the title page after item [22], please insert the following:

[30] Foreign Application Priority Data

April 6, 1988 [JP] Japan . . . . . 85863/1988

Signed and Sealed this

Thirtieth Day of June, 1992

*Attest:*

DOUGLAS B. COMER

*Attesting Officer*

*Acting Commissioner of Patents and Trademarks*